US009676197B2

(12) United States Patent
Karasawa et al.

(10) Patent No.: US 9,676,197 B2
(45) Date of Patent: Jun. 13, 2017

(54) LIQUID CONTAINER

(71) Applicant: Seiko Epson Corporation, Tokyo (JP)

(72) Inventors: Masahiro Karasawa, Matsumoto (JP); Satoru Kobayashi, Matsumoto (JP); Hiroshi Nose, Shiojiri (JP); Naoki Naito, Matsumoto (JP); Ryoji Fujimori, Suwa (JP); Takeshi Iwamuro, Matsumoto (JP); Yuji Aoki, Hara (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 14/929,852

(22) Filed: Nov. 2, 2015

(65) Prior Publication Data

US 2016/0229189 A1 Aug. 11, 2016

(30) Foreign Application Priority Data

Feb. 5, 2015 (JP) ..... 2015-020965

(51) Int. Cl.
*B41J 2/175* (2006.01)

(52) U.S. Cl.
CPC ..... *B41J 2/175* (2013.01); *B41J 2/17513* (2013.01); *B41J 2/17523* (2013.01); *B41J 2/17553* (2013.01)

(58) Field of Classification Search
CPC .... B41J 2/175; B41J 2/17513; B41J 2/17523; B41J 2/17553
See application file for complete search history.

(56) References Cited

U.S. PATENT DOCUMENTS 6,183,077 B1 * 2/2001 Hmelar ..... B41J 2/17506 347/86
2010/0245474 A1 9/2010 Okubo

FOREIGN PATENT DOCUMENTS

JP 2010-228206 A 10/2010

* cited by examiner

*Primary Examiner* — Stephen Meier
*Assistant Examiner* — Alexander D Shenderov
(74) *Attorney, Agent, or Firm* — Harness, Dickey & Pierce, P.L.C.

(57) ABSTRACT

A liquid container 16 mountable to a printing apparatus 11 that performs printing by discharging a liquid and capable of storing a liquid supplied in a pressurized state is provided with a liquid introduction part 47 through which the liquid is introduced, a tank 38 capable of storing the liquid introduced from the liquid introduction part 47, and a liquid supply part 48 that supplies the liquid in the tank 38 to a printing apparatus 11, and the tank 38 is molded to have flexibility.

9 Claims, 7 Drawing Sheets

LIQUID CONTAINER

BACKGROUND

1. Technical Field

The present invention relates to a liquid container that is for mounting to a printing apparatus such as an inkjet printer, for example, and can temporarily store a liquid such as ink to be supplied from a liquid supply source such as an ink cartridge to a print part that performs printing by discharging the liquid.

2. Related Art

Conventionally, there are liquid flow path units (liquid containers) constituting a portion of a flow path for supplying ink (liquid) from a cartridge (liquid supply source) to a head body (for example, JP-A-2010-228206). These liquid flow path units have a standard-size container with an opening in one face, and the opening of the container is covered with a film member so as to form a pressure chamber (tank) that can temporarily store the ink.

In other words, for example, in the case where vibrations are received from outside, the pressure chamber suppresses pulsation of the ink stored therein by the film member bending.

Incidentally, the pressure chamber of such a liquid flow path unit is formed by fixing or attaching the film member to the edge of the opening of the container. Therefore, for example, when ink is supplied from the cartridge in a pressurized state, the film member can peel off or be ripped, causing the ink to leak.

Note that such a problem is not limited to the liquid flow path unit provided in the printer and is generally common with liquid containers that temporarily store liquid to be supplied from the liquid supply source to the print part.

SUMMARY

An advantage of some aspects of the invention is to provide a liquid container capable of reducing the possibility of a liquid leaking.

Means for solving the above problem and the actions and effects thereof will be described below.

A liquid container for solving the above problem is a liquid container mountable to a printing apparatus that performs printing by discharging a liquid and capable of storing a liquid supplied in a pressurized state, the liquid container including a liquid introduction part through which the liquid is introduced, a tank capable of storing the liquid introduced from the liquid introduction part, and a liquid supply part that supplies the liquid in the tank to the printing apparatus, wherein the tank is molded to have flexibility.

According to this configuration, the tank is molded to have flexibility and thus is more robust compared with a tank that is formed by fixing or attaching a different member such as a film member to the edge of an opening of a container, for example. Thus, for example, even in the case of storing a liquid supplied in a pressurized manner, the possibility of the liquid leaking can be reduced.

In the above liquid container, preferably the tank is molded by blow molding.

According to this configuration, the tank is molded by blow molding, and thus the tank can be molded easily.

Preferably, the above liquid container is removable from the printing apparatus.

According to this configuration, the liquid container mounted to the printing apparatus can be easily removed from the printing apparatus. Therefore, for example, even in the case of storing a sedimentary liquid, sedimentation can be easily reduced by removing the liquid container from the printing apparatus and stirring the liquid.

In the above liquid container, preferably the liquid introduction part and the liquid supply part are formed such that a first central axis passing through a center of an introduction port that opens outward in the liquid introduction part is substantially parallel with a second central axis passing through a center of a supply port that opens outward in the liquid supply part, and the liquid introduction part and the liquid supply part extend in a mounting direction when the liquid container is mounted to the printing apparatus.

According to this configuration, the introduction port of the liquid introduction part and the supply port of the liquid supply part can be connected to the printing apparatus by the operation of mounting the liquid container to the printing apparatus. That is, one operation enables a plurality of connections (to be made), and thus the liquid container can be quickly mounted and removed.

In the above liquid container, preferably the introduction port that opens outward in the liquid introduction part and the supply port that opens outward in the liquid supply part open forward in the mounting direction in which the liquid container is mounted to the printing apparatus.

According to this configuration, the introduction port of the liquid introduction part and the supply port of the liquid supply part can be connected to the printing apparatus by the operation of mounting the liquid container to the printing apparatus. That is, one operation enables a plurality of connections, and thus the liquid container can be quickly mounted and removed.

In the above liquid container, preferably the tank is formed by integrally molding an opening portion to which the liquid introduction part and the liquid supply part are to be connected and a body portion that has flexibility.

According to this configuration, the opening portion and the body portion are integrally molded, and thus the possibility of liquid leaking can be further reduced.

BRIEF DESCRIPTION OF THE DRAWINGS

The invention will be described with reference to the accompanying drawings, wherein like numbers reference like elements.

DESCRIPTION OF EXEMPLARY EMBODIMENTS

One embodiment of a liquid container will be described below with reference to the drawings. The liquid container is, for example, a sub tank that is mounted to a printing apparatus such as an inkjet printer that performs printing (recording) by discharging ink, as an example of a liquid, onto a medium such as paper, and temporarily stores ink supplied from a cartridge as an example of a liquid supply source.

Figure 1:
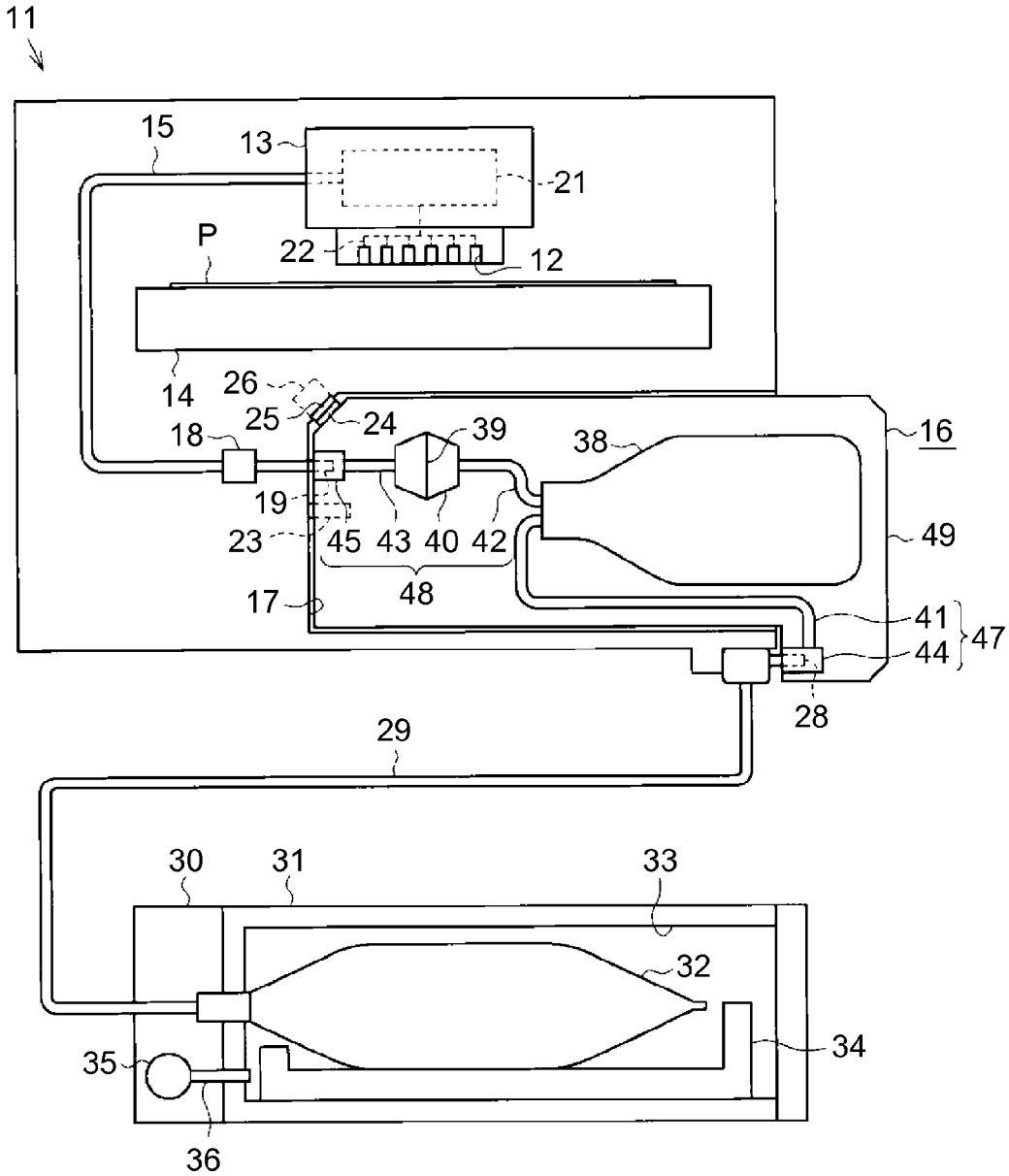
FIG. 1 is a schematic diagram showing, in a simplified manner, one embodiment of a liquid container in a state of being mounted to a printing apparatus.

As shown in FIG. 1, a printing apparatus 11 of this embodiment is provided with a print part 13 having a plurality of nozzles 12 for discharging a liquid onto a medium P, and a support base 14 that supports the medium P. The printing apparatus 11 is further provided with a liquid supply path 15 for supplying the liquid to the print part 13, and a mount part 17 for mounting a liquid container 16. Moreover, a supply pump 18 is provided at partway along the liquid supply path 15, and a supply needle 19 is provided at the upstream end of the liquid supply path 15, which is positioned in the mount part 17.

The print part 13 is provided with a pressure control mechanism 21 with which the downstream end of the liquid supply path 15 communicates, and a communication flow path 22 that allows the pressure control mechanism 21 and the nozzles 12 to communicate with each other. In the case where the pressure in the communication flow path 22 reaches a negative pressure that is lower than a preset threshold value Pm (Pm<0) due to factors such as the liquid being discharged from the nozzles 12, the pressure control mechanism 21 allows the liquid supply path 15 and the communication flow path 22 to communicate with each other.

On the other hand, when the pressure in the communication flow path 22 is larger than or equal to the threshold value Pm, the pressure control mechanism 21 regulates the communication between the liquid supply path and the communication flow path 22. Therefore, even when the liquid in the liquid supply path 15 is in a pressurized state due to the supply pump 18 being driven, the liquid is not supplied to the nozzles 12 in the state where the pressure control mechanism 21 regulates communication between the liquid supply path 15 and the communication flow path 22.

The liquid container 16 is removably mounted to the mount part 17. That is, the liquid container 16 is mountable and removable with respect to the printing apparatus 11. Note that in the case where the print part 13 discharges a plurality of types of liquid (for example, ink of a plurality of colors such as cyan, magenta, yellow and black), the printing apparatus 11 is provided with a plurality of mount parts 17. Also, liquid containers 16 individually storing different types of liquid are mounted in the mount parts 17.

Moreover, a positioning pin 23 for positioning the liquid container 16 by engaging with this mounted liquid container 16 is provided substantially parallel to the supply needle 19 on the far side of where the supply needle 19 is provided in the mount part 17. Furthermore, a connection terminal 25 and a connection detecting part 26 that are electrically connectable to a terminal part of a circuit board 24 provided in the liquid container 16 are provided at an upper position on the far side in the mount part 17. Accordingly, the connection detecting part 26 detects information of the circuit board 24 connected to the connection terminal 25, and thereby a control part (not illustrated) determines that the liquid container 16 is mounted in the mount part 17.

Furthermore, a connection needle 28 that extends in a direction substantially parallel to a direction in which the supply needle 19 extends is provided on the mount part 17. Note that this connection needle 28 is provided at the downstream end of a supply flow path 29, and a feeding mechanism 30 and a cartridge holder 31 are provided upstream of the supply flow path 29.

The cartridge holder 31 has a storage chamber 33 that houses a cartridge 32 storing liquid. Also, for example, the cartridge 32 is put into and taken out from the storage chamber 33 in the state where the cartridge 32 is placed in a tray 34, and thereby the cartridge 32 is mounted to and removed from the cartridge holder 31.

The feeding mechanism 30 is provided with a pressurized supply part 35 for feeding pressurized air and a pressurized air supply path 36 for introducing the pressurized air fed from the pressurized supply part 35 into the storage chamber 33. The pressurized supply part 35 feeds the pressurized air through the pressurized air supply path 36 into the storage chamber 33 so as to pressurize the cartridge 32. The liquid stored in the cartridge 32 is then supplied to the liquid container 16 via the supply flow path 29.

Next, the configuration of the liquid container that can store the liquid supplied in a pressurized state will be described.

As shown in FIG. 1, the liquid container 16 is provided with a tank 38 as an example of a liquid storage part that can store liquid in an liquid-tight manner, a filter storage part 40 for housing a filter 39, and a plurality of (three, in this embodiment) supply paths 41 to 43 connected to the tank 38 and/or the filter storage part 40.

That is, a first connection part 44 that can be connected to the connection needle 28 is provided at the upstream end of the first supply path 41, and the downstream end of the first supply path 41 is connected to the tank 38. Moreover, the upstream end of the second supply path 42 is connected to the tank 38, and the downstream end of the second supply path 42 is connected to the filter storage part 40. Also, the upstream end of the third supply path 43 is connected to the filter storage part 40, and a second connection part 45 that can be connected to the supply needle 19 is provided at the downstream end of the third supply path 43.

Therefore, when the liquid container 16 is mounted in the mount part 17, the connection needle 28 and the first connection part 44 are connected so that the first supply path 41 and the supply flow path 29 communicate with each other. Furthermore, the supply needle 19 and the second connection part 45 are connected so that the third supply path 43 and the liquid supply path communicate with each other. Note that in this embodiment, the first connection part 44 and the first supply path 41 constitute a liquid introduction part 47 through which liquid is introduced. Furthermore, in this embodiment, a liquid supply part 48 for supplying liquid in the tank 38 to the printing apparatus 11 is formed by the filter storage part 40, the second supply path 42, the third supply path 43, and the second connection part 45. Moreover, the tank 38, the liquid introduction part 47 and the liquid supply part 48 are housed in a cover 49 made of synthetic resin.

Figure 2:
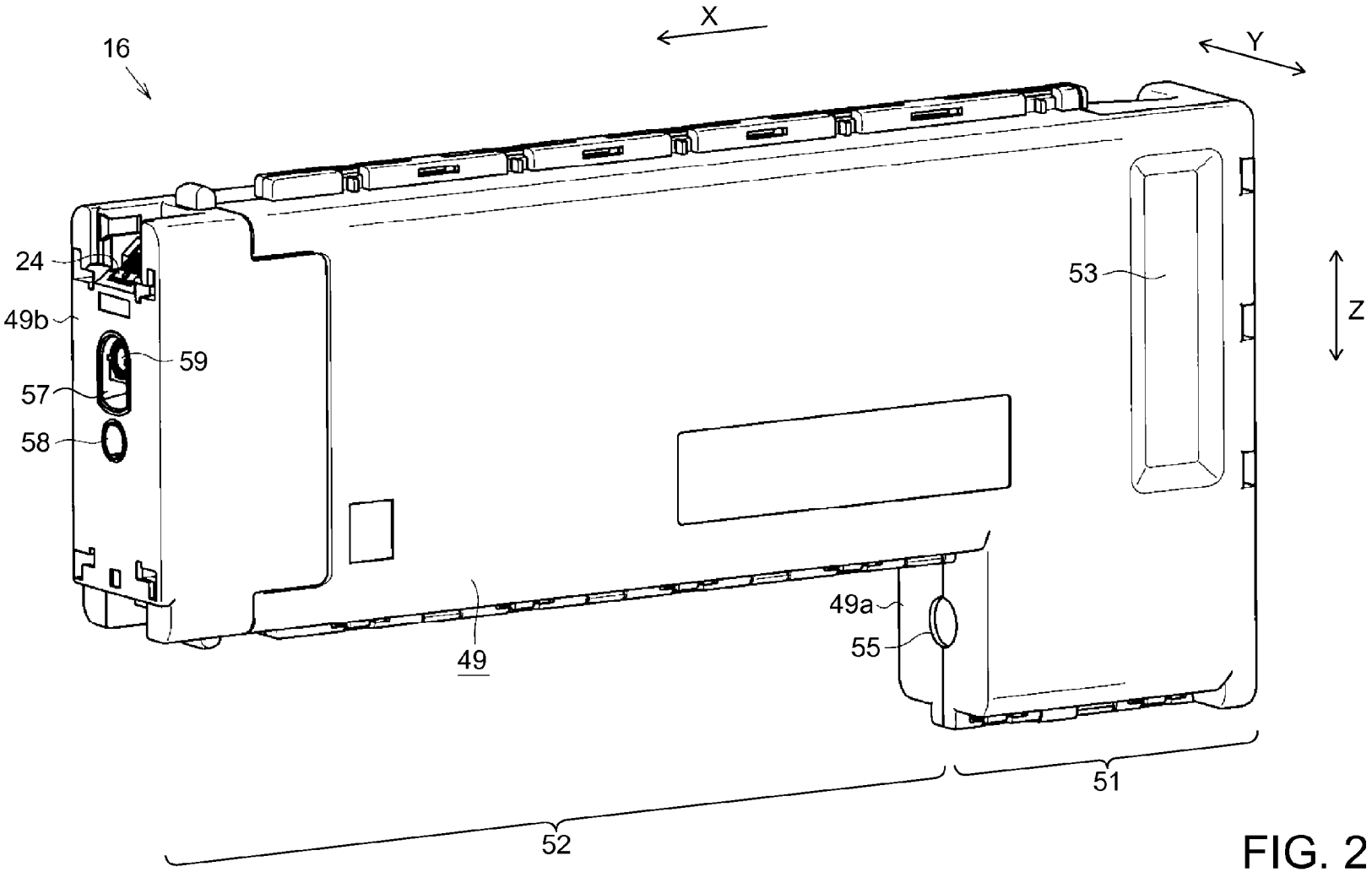
FIG. 2 is a perspective view of a liquid container.

As shown in FIG. 2, assuming that a mounting direction X that is a direction in which the liquid container 16 is moved when being mounted in the mount part 17 is a longitudinal direction, the cover 49 has a certain width in a width direction Y that is a traverse direction intersecting (orthogonal to) the mounting direction X. The liquid container 16 has a first storage portion 51 that is a portion in which the first connection part 44 is provided and has a size in a height direction z intersecting (orthogonal to) the mounting direction X and the width direction Y that is larger than other portions thereof in the mounting direction X, and a second storage portion 52 that has a size in the height direction Z that is smaller than the first storage portion 51.

Furthermore, out of the first storage portion and the second storage portion 52, the first storage portion 51, which is on the rear side in the mounting direction X, has holding portions 53 recessed and formed on two side surfaces of the cover 49. That is, the liquid container 16 is inserted into the mount part 17 from the second storage portion 52 side (front side in the mounting direction X) in the state where the holding portions 53 are held by a user, and is thereby mounted to the printing apparatus 11.

Figure 3:
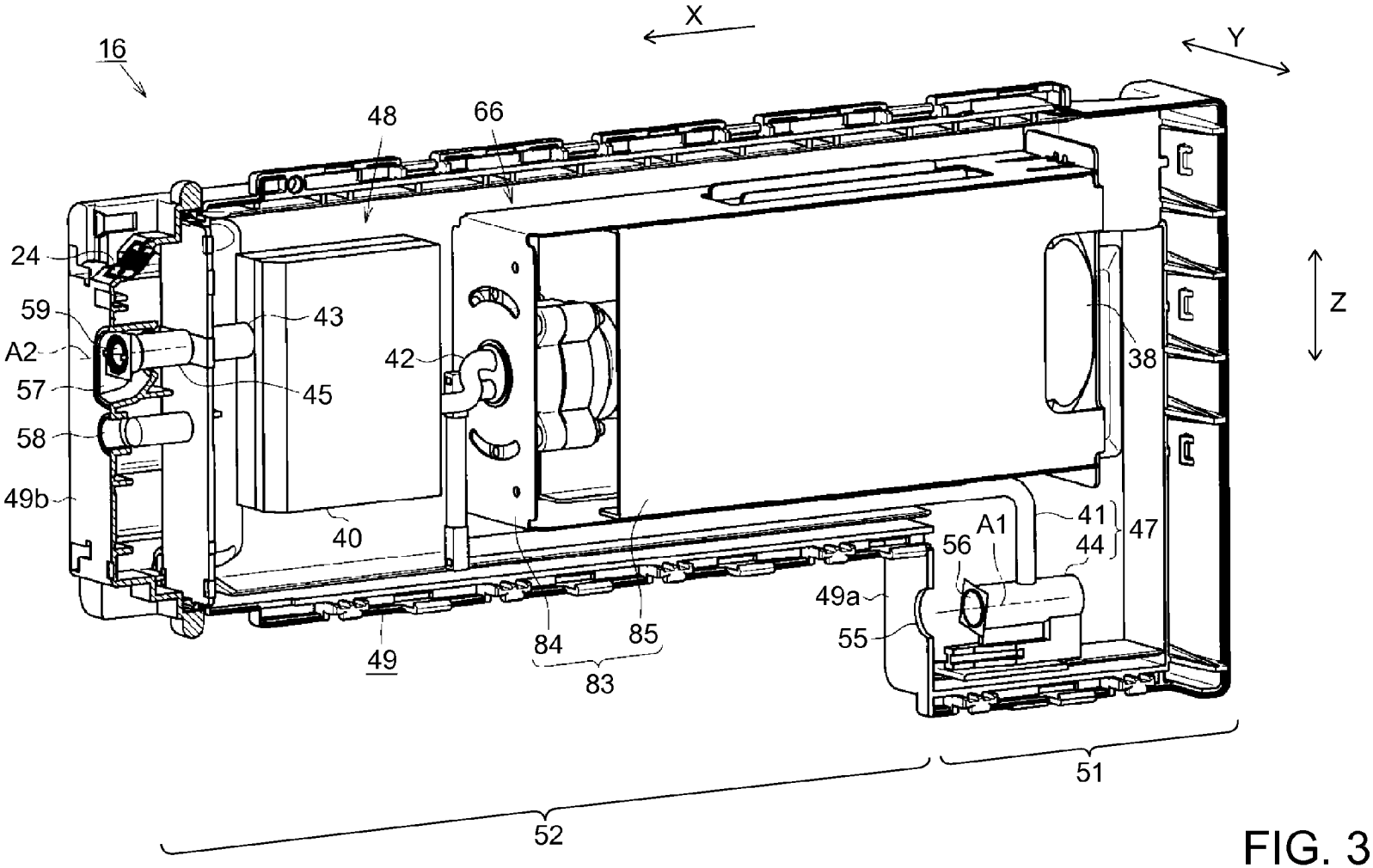
FIG. 3 is a cross-sectional perspective view of the liquid container.

As shown in FIGS. 2 and 3, a first insertion hole 55 into which the connection needle 28 is inserted is formed on a first front surface 49*a* of the cover 49 in the first storage portion 51. Furthermore, an introduction port 56 that opens forward in the mounting direction X is formed on the first connection part 44 so as to be aligned with the first insertion hole 55. That is, the introduction port 56 in the liquid introduction part 47 is formed to open outward.

Moreover, a second insertion hole 57 into which the supply needle 19 is inserted and a third insertion hole 58 into which the positioning pin 23 is inserted are formed on a second front surface 49*b* of the cover 49 in the second storage portion 52. Furthermore, a supply port 59 that opens forward in the mounting direction X is formed on the second connection part 45 so as to be aligned with the second insertion hole 57. That is, the supply port 59 of the liquid supply part 48 is formed to open outward.

Moreover, a first central axis A1 passing through the center of the introduction port 56 and a second central axis A2 passing through the center of the supply port 59 are substantially parallel, and are formed so as to extend along the mounting direction X when the liquid container 16 is mounted to the printing apparatus 11.

Figure 4:
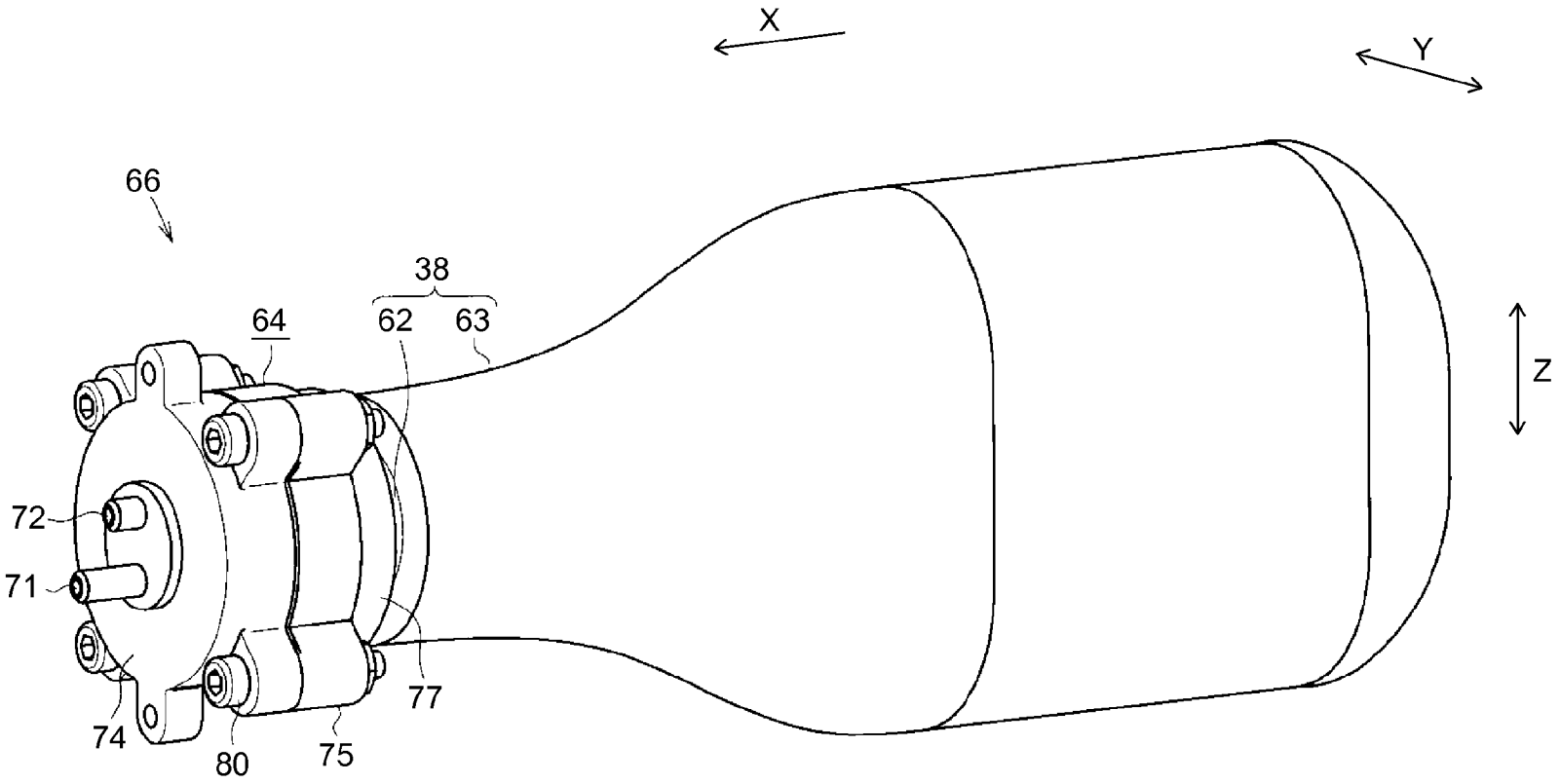
FIG. 4 is a perspective view of a tank unit.
Figure 5:
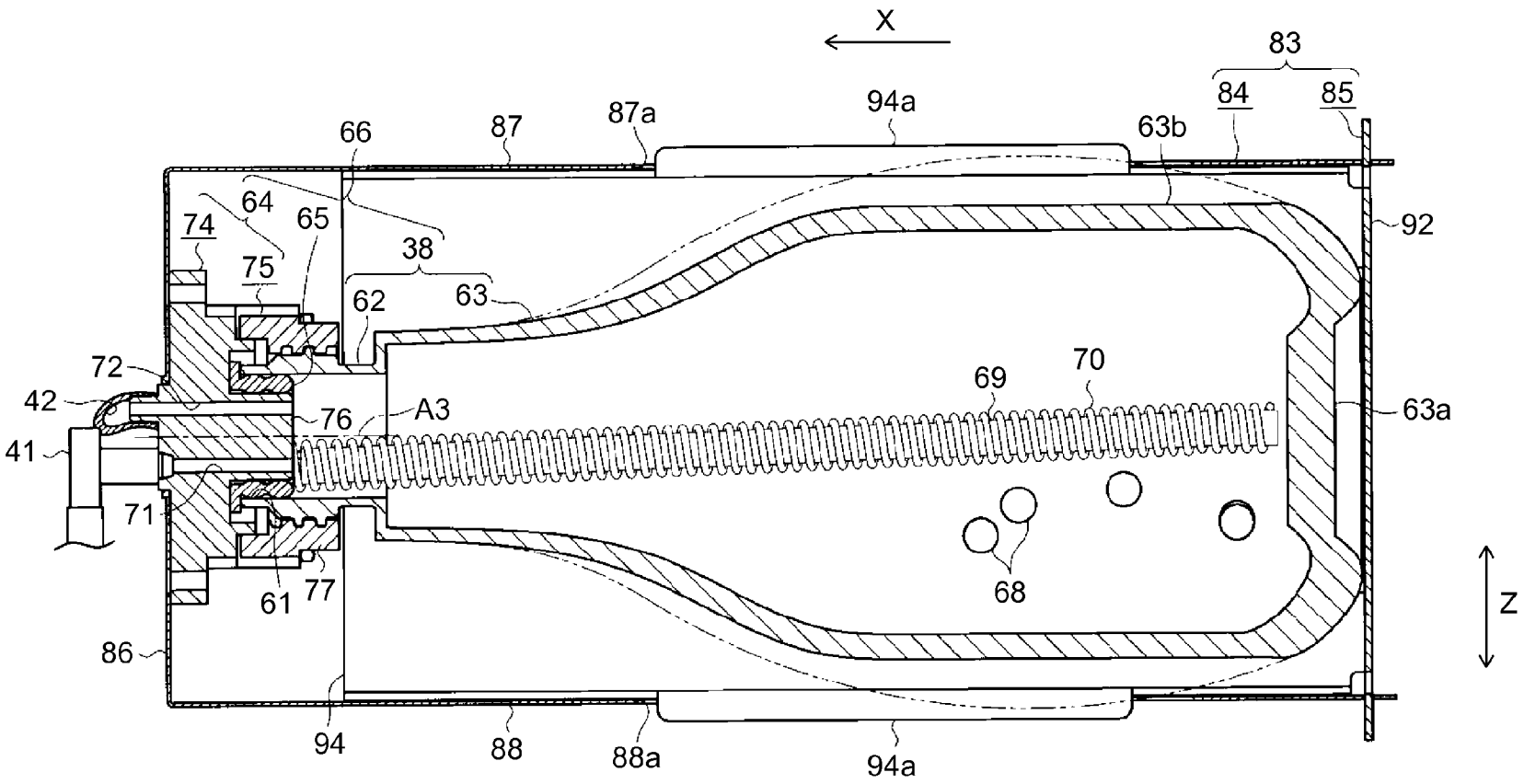
FIG. 5 is a cross-sectional view of a suppression member and the tank unit.

As shown in FIGS. 4 and 5, the tank 38 is integrally molded to have flexibility by blow molding. That is, the tank 38 is a hollow tube container formed by heating a parison made of resin such as low density polyethylene, and injecting air into and expanding the parison, for example.

Moreover, the tank 38 is formed by integrally molding a cylindrical wall portion 62 as an example of a wall portion having an opening portion 61 to which the liquid introduction part 47 and the liquid supply part 48 are to be connected, and a body portion 63 that has flexibility and can store liquid. The body portion 63 of the tank 38 is formed to have a thickness that allows the body portion 63 to bend in response to the change in the amount of the stored liquid. The liquid container 16 is further provided with a lid part 64 for covering the opening portion 61 of the tank 38, and a sealing member 65 for sealing the opening portion 61. Also, a tank unit 66 as an example of a liquid storage unit is constituted by the tank 38, the lid part 64, and the sealing member 65.

The tank 38 has the cylindrical wall portion 62 formed to have a substantially cylindrical shape, while the body portion 63 is formed to have a bottom portion 63*a* and have a substantially elliptic cylindrical shape. That is, the body portion 63 has a flat shape with the size in the height direction Z (width) larger than the size in the width direction Y (width). The tank 38 is a narrow-mouthed tube container in which the cross-sectional area of the cylindrical wall portion 62 is smaller than the cross-sectional area of the body portion 63, and the cross-sectional area of a portion, of the body portion 63, that is close to the cylindrical wall portion 62 gradually decreases in size toward this cylindrical wall portion 62. Note that a male screw engageable with the lid part 64 is formed on the outer surface of the cylindrical wall portion 62.

As shown in FIG. 5, in the tank 38, the bottom portion 63*a* positioned at a position separated from the opening portion 61 and facing the opening portion 61 is thicker than a trunk body portion 63*b* of the body portion 63 that excludes the bottom portion 63*a*. Therefore, the trunk body portion 63*b* of the body portion 63 is more flexible than the bottom portion 63*a*. Moreover, in the bottom portion 63*a*, the central portion of this bottom portion 63*a* is recessed and formed to be positioned inward of the tank 38 from the periphery.

Moreover, in the case where the tank 38 collapses as the amount of the stored liquid is reduced, the tank 38 deforms such that the size (width) of the trunk body portion 63*b* in the width direction Y as an example of a first direction is reduced, whereas the size (width) in the height direction Z as an example of a second direction intersecting the first direction increases; that is, the tank 38 deforms to have an even thinner flat shape. On the other hand, when liquid is introduced in the tank 38 in a flattened state and the amount of the stored liquid increases, the tank 38 expands such that the size (width) of the trunk body portion 63*b* in the width direction Y increases, whereas the size (width) in the height direction Z is reduced. Note that when further liquid is introduced, the tank 38 expands such that the central portion of the bottom portion 63*a* also deforms outward.

Moreover, a stirring member 68 for stirring the liquid in the tank 38, a tube 69 that enables introduction of the liquid deep into the tank 38, and a coil 70 wound around the tube 69 are provided in the tank 38. Note that the specific gravity of the stirring member 68 is greater than the specific gravity of the liquid (to be) stored in the tank 38, and the stirring member 68 is positioned at a lower position in the tank 38 when not used.

Moreover, in the lid part 64, a liquid inflow path 71 to which the downstream end of the first supply path 41 is connected is formed, and a liquid outflow path as an example of a liquid outflow part to which the upstream end of the second supply path 42 is connected so as to allow outflow of the liquid from the tank 38 is formed. Also, the base end of the tube 69 is connected to the liquid inflow path 71, and the tube 69 and the liquid inflow path 71 function as an example of a liquid inflow part that allows inflow of the liquid into the tank 38. That is, in the tank 38, the tip portion of the tube 69, which is the end of the liquid inflow part, is at a position more separated from the lid part 64 than the end of the liquid outflow path 72, which is the end of liquid outflow part.

Figure 6:
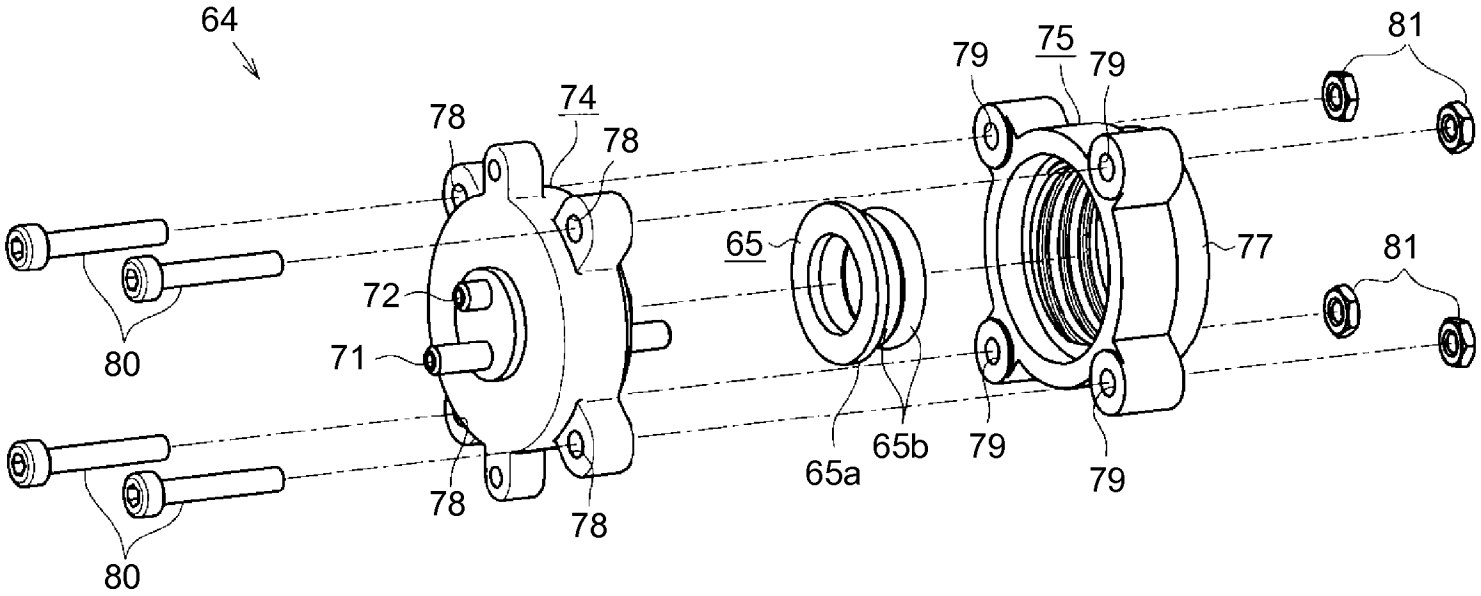
FIG. 6 is an exploded perspective view of a lid part.

As shown in FIGS. 5 and 6, the lid part 64 has a first cap member 74 and a second cap member 75. On this first cap member 74, a substantially columnar first protrusion portion 76 that can be inserted into the opening portion 61 of the cylindrical wall portion 62 of the tank 38 is formed, and a cylindrical second protrusion portion 77 into which the cylindrical wall portion 62 of the tank 38 can be inserted is formed on the second cap member 75. Note that the first protrusion portion 76 and the second protrusion portion 77 sandwich the cylindrical wall portion 62 of the tank 38 in a direction intersecting (orthogonal to) a virtual central axis A3 passing through the center of the opening portion 61 in the state where the lid part 64 is mounted to the tank 38. In particular, the first protrusion portion 76, the sealing member 65, the cylindrical wall portion 62, and the second protrusion portion 77 are arranged, in this order, outward from the virtual central axis A3, and are arranged on a line intersecting (orthogonal to) the virtual central axis A3. Moreover, the first protrusion portion 76 is formed in a tapered shape with the cross sectional shape thereof decreasing from the opening portion 61 side toward the body portion 63 side.

The liquid inflow path 71 and the liquid outflow path 72, which are two parallel flow paths passing through the entirety of the first cap member 74 including the first protrusion portion 76 along the axial direction of the first protrusion portion 76, are formed in the first cap member 74.

Note that two projections having different lengths are projectingly formed in parallel on the outer end face of the first cap member 74 (the end face on the side opposite to the side on which the first protrusion portion 76 protrudes), whereas a projection arranged coaxially with the longer projection on the outer end face side is projectingly formed on the inner end face of the first cap member 74 (the top end face of the first protrusion portion 76). Moreover, one end of the liquid inflow path 71 passing through the first cap member 74 opens at the tip of the longer projection on the outer end face side, and the other end opens at the tip of the projection on the inner end face side. On the other hand, one end of the liquid outflow path 72 passing through the first cap member 74 in parallel to the liquid inflow path 71 opens at the tip of the shorter projection on the outer end face side, and the other end opens on the inner end face, which is the top end face of the first protrusion portion 76. Moreover, the inner diameter of the second protrusion portion 77 is greater than the outer diameter of the first protrusion portion 76. Furthermore, a female screw that is engageable with the male screw formed on the cylindrical wall portion 62 is formed on the inner surface of the second protrusion portion 77.

As shown in FIG. 6, at least one (four, in this embodiment) first opening 78 is formed in the first cap member 74, and at least one (four, in this embodiment, which is the same as the number of first openings 78) second opening 79 is formed in the second cap member 75. The first cap member 74 and the second cap member 75 are then fastened by a nut 81 being screwed into a bolt 80 that is inserted into the first opening 78 and the second opening 79. Note that in this embodiment, the bolt 80 and the nut 81 function as an example of a fastening member.

As shown in FIGS. 5 and 6, the sealing member 65 is formed of an elastomer having elasticity, for example. This sealing member 65 has an annular flange portion 65*a* having a substantially constant thickness, and two ring portions 65*b* having a torus shape. Note that the inner diameter of the flange portion 65*a* is slightly larger than the outer diameter of the first protrusion portion 76, and is smaller than the inner diameter of the opening portion 61. Furthermore, the outer diameter of the flange portion 65*a* is greater than the inner diameter of the opening portion 61, and is smaller than the inner diameter of the second protrusion portion 77. Moreover, the inner diameter of the ring portion 65*b* is slightly smaller than the outer diameter of the first protrusion portion 76, and the outer diameter of the ring portion 65*b* is slightly greater than the inner diameter of the opening portion 61. Therefore, the sealing member 65 is positioned between the first protrusion portion 76 and the second protrusion portion 77, with the ring portion 65*b* being press fitted into from the opening portion 61 and the flange portion 65*a* being engaged with the end of the cylindrical wall portion 62.

Figure 7:
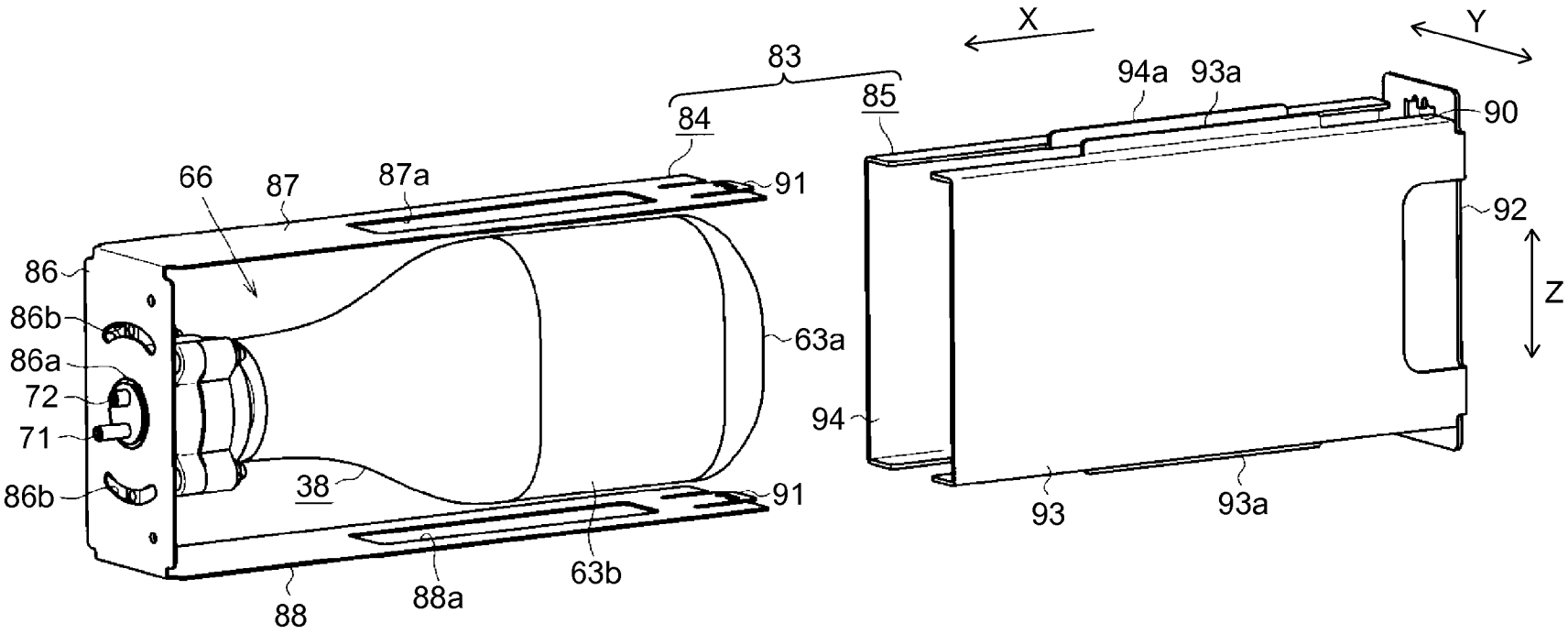
FIG. 7 is an exploded perspective view of the tank unit and the suppression member.

As shown in FIGS. 3 and 7, the liquid container is provided with the suppression member 83 for suppressing the expansion of the tank 38 in the case where the tank 38 expands due to the liquid being stored therein. That is, the liquid container 16 is constituted by the tank unit 66 covered with the suppression member 83 being housed in the cover 49, and the suppression member 83 is covered with the cover 49. Moreover, this suppression member 83 is constituted by a first suppression part 84 and a second suppression part 85 being engaged with each other. Note that the first suppression part 84 and the second suppression part 85 are formed by bending metal plates.

As shown in FIG. 7, the first suppression part 84 is provided with a front plate part 86, and an upper plate part 87 and a lower plate part 88 that is bent to be substantially vertical to the front plate part 86. On the front plate part 86, a through hole 86*a* that allows insertion of the longer projection through which the liquid inflow path 71 is formed to pass, and the shorter projection through which the liquid outflow path 72 is formed to pass is formed, and a pair of long holes 86*b* into which screws (not illustrated) are to be inserted to fix the tank unit 66 are formed.

Moreover, the upper plate part 87 and the lower plate part 88 are provided to have a space therebetween in the height direction Z, and have, in the height direction Z, substantially rectangle openings 87*a* and 88*a* through which portions of the tank 38 can pass. Furthermore, on the upper plate part 87 and the lower plate part 88, engaging portions 91 that engage with engagement portions 90 of the second suppression part 85 are formed at a rear end on an opposite side to the front plate part 86. On two sides of the engaging portion 91 in the width direction Y, a slit is formed along the mounting direction X, and the engaging portion 91 has a cantilever shape. Then, in the case where the first suppression part 84 and the second suppression part 85 are engaged, the engaging portion 91 engages with the engagement portion 90 of the second suppression part 85 while being bending.

Moreover, the second suppression part 85 has a rear plate part 92 having the engagement portions 90 formed at the two ends thereof in the height direction Z, and a pair of side plate parts 93 and 94 substantially vertical to the rear plate part 92 and facing each other. Note that the upper ends and the lower ends of the side plate parts 93 and 94 are bent such that projection portions 93*a* and 94a are formed. These projection portions 93*a* and 94a are positioned in the openings 87*a* and 88*a* of the first suppression part 84 in the case where the first suppression part 84 and the second suppression part 85 are engaged, and position the first suppression part 84 and the second suppression part 85 in the width direction Y. Therefore, in the tank 38, the trunk body portion 63*b* of the body portion 63 is covered with the upper plate part 87, the lower plate part 88, and the side plate parts 93 and 94 of the suppression member 83, and the bottom portion 63*a* is covered with the rear plate part 92 of the suppression member 83.

Next, assembly of the tank unit 66 will be described.

As shown in FIG. 5, the female screw of the second cap member 75 is first screwed to the male screw formed on the cylindrical wall portion 62 of the tank 38. That is, the second cap member 75 is mounted to the cylindrical wall portion 62, before the first cap member 74 is mounted to the cylindrical wall portion 62. Subsequently, the stirring member 68 is put into the tank 38, and the sealing member 65 is mounted to the opening portion 61. Note that the sealing member 65 is pushed into the opening portion 61 in the state where the inner wall of the cylindrical wall portion 62 and the ring portion 65*b* adhere to each other.

Next, the first cap member 74, which is to be mounted to the cylindrical wall portion 62 by the projection on the inner end face side being inserted into the tube 69 with the coil 70 wound thereon, is mounted to the cylindrical wall portion 62. In particular, the first cap member 74 is mounted such that the first protrusion portion 76 is pushed into the sealing member 65. Note that the protrusion portion 76 is formed in a taper that tapers toward the tip thereof, and thus the further the protrusion portion 76 is pushed into the sealing member 65, the more the protrusion portion 76 adheres to the sealing member 65.

Incidentally, the tank 38 is formed by blow molding by integrally molding the cylindrical wall portion 62 and the body portion 63, and thus the cylindrical wall portion 62 also has flexibility. However, the second cap member 75 is mounted earlier than the first cap member 74, and thus deformation of the cylindrical wall portion 62 is suppressed even if pressed by the first cap member 74. In this state, the first cap member 74 and the second cap member 75 are fastened with the bolt 80 and the nut 81.

Next, the actions of the printing apparatus 11 having the liquid container 16 mounted therein will be described. Note that the liquid container 16 is mounted in the mount part 17 in the state where liquid is stored in the tank 38.

As shown in FIGS. 1 and 5, when the pressurized supply part 35 sends out pressurized air through the pressurized air supply path 36 into the storage chamber 33, the liquid stored in the cartridge 32 is supplied to the tank 38 via the supply flow path 29, the connection needle 28, the liquid introduction part 47, the liquid inflow path 71, and the tube 69.

The tank 38 supplied with the liquid then expands. That is, the easily deformable trunk body portion 63*b* of the tank 38 widens in the width direction Y. Note that the tank 38 is covered with the suppression member 83, and thus when the expanded trunk body portion 63*b* comes into contact with the side plate parts 93 and 94, further expansion of the trunk body portion 63*b* is suppressed. When liquid is further introduced in this state, the bottom portion 63*a* of the tank 38 also expands. When the expanded bottom portion 63*a* come into contact with the rear plate part 92, further expansion of the bottom portion 63*a* is suppressed.

Moreover, when the supply pump 18 is driven, the liquid in the liquid supply path 15 is pressurized. When the liquid is discharged from the nozzles 12, the discharged amount of liquid is supplied to the print part 13. That is, the liquid stored in the tank 38 passes via the liquid outflow path 72, the liquid supply part 48, the supply needle 19, and the liquid supply path 15, and thereby liquid that has passed through the filter 39 and has reduced air bubbles and foreign materials is supplied. Moreover, the tank 38 has flexibility, and thus the liquid that was stored in the tank 38 and to which pulsation was suppressed is supplied to the print part 13. At this time, in the tank 38, the liquid that flows near the bottom portion 63*a* is supplied from the lid part 64 side via the tube 69, and thereby the liquid flows over a wide area in the tank 38.

Moreover, even in the case where the cartridge 32 contains no ink, and the liquid is not supplied from the cartridge 32 to the tank 38, printing can be continued by supplying the liquid stored in the tank 38 to the print part 13. Note that when the liquid is supplied from the tank 38 to the print part 13 and the liquid in the tank 38 is reduced, the tank 38 deforms so as to collapse. That is, the trunk body portion 63*b* of the tank 38 is reduced in size in the width direction Y so as to have an even thinner flat shape and is increased in size in the height direction Z as indicated by dashed double-dotted lines in FIG. 5. Note that the upper plate part 87 and the lower plate part have the openings 87*a* and 88*a* respectively formed thereon, and thus portions (the trunk body portion 63*b* of the body portion 63) of the tank 38 that has increased in size in the height direction Z extend through the openings 87*a* and 88*a* to allow the tank 38 to deform.

Next, the actions in the case where the liquid container 16 stores a liquid in which sedimentation can occur such as pigment ink will be described.

Here, in the case where printing is not performed only during the time when sedimentation can occur in the liquid stored in the tank 38, the printing apparatus 11 informs the user of the need to stir the liquid in the liquid container 16 using an information part (not illustrated).

That is, the printing apparatus 11 instructs the user to pull out the liquid container 16 from the mount part 17, and shake the liquid container 16. Note that in the shaken liquid container 16, the stirring member 68 moves in the tank 38 so as to reduce sedimentation of the liquid in the tank 38. The printing apparatus 11 then instructs the user to mount the liquid container 16 in the mount part 17. That is, the liquid container 16 is inserted into the mount part 17 along the mounting direction X such that the supply needle 19 is inserted into the supply port 59, and the connection needle 28 is inserted into the introduction port 56.

In accordance with the above embodiment, effects such as the following can be obtained.

(1) The tank 38 is molded to have flexibility, and thus is more robust compared with a tank that is formed by fixing or attaching a different member such as a film member to the edge of an opening of a container, for example. Therefore, for example, even in the case of storing liquid supplied in a pressurized manner, the possibility of the liquid leaking can be reduced.

(2) The tank 38 is molded by blow molding, and thus the tank 38 can be molded easily.

(3) The liquid container 16 mounted to the printing apparatus 11 can be easily removed from the printing apparatus 11. Therefore, for example, even in the case of storing a sedimentary liquid, sedimentation can be easily reduced by removing the liquid container 16 from the printing apparatus 11 and stirring the liquid.

(4) The introduction port 56 of the liquid introduction part 47 and the supply port 59 of the liquid supply part 48 can be connected to the printing apparatus 11 by the operation of mounting the liquid container 16 to the printing apparatus 11. That is, one operation enables a plurality of connections, and thus the liquid container 16 can be quickly mounted and removed.

(5) An opening portion and a body portion are integrally molded, and thus the possibility of liquid leaking can be further reduced.

(6) The tank 38 has flexibility, and thus expands when storing pressurized liquid. However, the expansion of the tank in that case is suppressed by the suppression member 83. Therefore, the possibility of the liquid leaking can be reduced by reducing the possibility of over expansion of the tank 38.

(7) The suppression member 83 has, in the width direction Y in which the tank 38 deforms such that the width of the tank 38 increases in the case where the liquid stored in the tank 38 is reduced, the openings 87*a* and 88*a* through which portions of the tank 38 pass. Therefore, the possibility of the suppression member 83 blocking the deformation of the tank 38 in the case where the liquid stored in the tank 38 decreases can be reduced.

(8) When the pressurized liquid is stored in the tank 38, the bottom portion 63*a* also expands in some cases. In this regard, it is possible to suppress the deformation of the bottom portion 63*a* by covering the bottom portion 63*a* with the suppression member 83, in the case where the tank 38 expands.

(9) Even in the case where the liquid leaks from the tank 38, the possibility of the liquid leaking out of the liquid container 16 can be reduced by further covering the tank 38 and the suppression member 83 with the cover 49.

(10) For example, the stirring member 68 can be moved and the liquid in the tank 38 can be efficiently stirred by removing the liquid container 16 from the printing apparatus 11 and shaking the liquid container 16. Moreover, when the liquid in the tank 38 flows, the tube 69 deforms in some cases. However, the tube 69 has the coil 70 wound thereon, and thus the possibility of the tube 69 deforming can be reduced.

(11) The sealing member 65 and the cylindrical wall portion 62 can be sandwiched by the first protrusion portion 76 and the second protrusion portion 77 formed on the lid part 64. That is, outward deformation of the cylindrical wall portion 62 that is pressed outward by the first protrusion portion 76 and the sealing member 65 is suppressed by the second protrusion portion 77. Therefore, the possibility of the liquid leaking from between the first protrusion portion 76 and the cylindrical wall portion 62 can be reduced.

(12) The first protrusion portion 76 is formed in a taper, and thus as the first protrusion portion 76 further engages the cylindrical wall portion 62, the force of the first protrusion portion 76 pressing the cylindrical wall portion 62 outward from inside gradually strengthens and the adhesion force between the first protrusion portion 76 and the cylindrical wall portion 62 via the sealing member 65 increases. Therefore, the possibility of liquid leaking can be further reduced.

(13) The second cap member 75 is mounted to the cylindrical wall portion 62 first. Therefore, in the case where the first cap member 74 is mounted to the cylindrical wall portion 62, deformation of the cylindrical wall portion 62 is suppressed by the second cap member 75. Therefore, the adhesion between the lid part 64 and the cylindrical wall portion 62 can be improved.

(14) The first cap member 74 and the second cap member 75 are fastened with the bolt 80 and the nut 81, and thus the possibility of the first cap member 74 and the second cap member 75 coming off can be reduced. Therefore, for example, even in the case where an impact is applied in cases such as when the tank unit 66 is removed from the printing apparatus 11 in order to stir the liquid or when the tank unit 66 is dropped, the possibility of the lid part 64 coming off can be reduced.

(15) In the case where the liquid is caused to flow into the tank 38 using the liquid inflow path 71 and the tube 69, the liquid is moved to a position that is more separated from the lid part 64, whereas in the case of causing the liquid to flow out of the tank 38 using the liquid outflow path 72, the liquid is caused to flow from a position close to the lid part 64. Therefore, it is possible to allow the liquid to flow over a broad area in the tank 38 compared with the case where the end of the tube 69 and the end of the liquid outflow path 72 are at the same position in the tank 38, and thus the generation of foreign materials and the occurrence of degradation and the like that are caused in the case where the liquid is retained can be suppressed.

(16) The cylindrical wall portion 62 and the lid part 64 sandwich the sealing member 65 in a direction intersecting (orthogonal to) the virtual central axis A3. Therefore, an area over which the sealing member 65, the cylindrical wall portion 62 and the lid part 64 adhere can be increased, compared with the case in which the cylindrical wall portion 62 and the lid part 64 sandwich the sealing member 65 in a direction along the virtual central axis A3. Therefore, the possibility of liquid leaking from between the cylindrical wall portion 62 and the lid part 64 can be further reduced.

Note that the above embodiment may be modified as follows.

In the above embodiment, the liquid container 16 may be configured such that a portion of the cover 49 can be opened/closed or attached/detached so that the filter storage part 40 can be replaced. Moreover, a configuration may be adopted in which a portion of the filter storage part 40 can be opened/closed or attached/detached, so that the filter 39 can be replaced. Furthermore, a configuration may be adopted in which the liquid container 16 does not have the filter 39 and the filter storage part 40.

In the above embodiment, the shape of the tank 38 can be arbitrarily changed. For example, the shape may be a polyhedron, a sphere, a cone, a column, an ellipsoid or the like, or may be a shape that combines these shapes. Note that the tank 38 (liquid storage part) is a container that can store liquid, and includes a narrow-mouthed bottle, a wide-mouthed jar, a bag made of a flexible material, and the like. Moreover, the opening portion 61 can be formed in an arbitrary position of containers such as these. Moreover, the cross sectional shapes of the opening portion 61 and the cylindrical wall portion 62 can also be changed to arbitrary shapes. In this case, a configuration may be adopted in which the lid part 64 has the first protrusion portion 76 and the second protrusion portion 77 that fit the shapes of the opening portion 61 and the cylindrical wall portion 62, and is mounted to the cylindrical wall portion 62 by means such as being fastened using a fastening member and being engaged using an engaging portion.

In the above embodiment, the tank 38 can be formed using an arbitrary material. For example, resin, metal, glass, an elastomer or the like may be used as the material. Moreover, polyethylene terephthalate, high density polyethylene, polypropylene, polyamide or the like may be used as the resin.

In the above embodiment, an arbitrary material can be used to form the suppression member 83 in an arbitrary shape as long as the suppression member 83 has enough rigidity to be able to suppress expansion of the tank 38. For example, a suppression member having a lattice pattern may be formed of resin or metal. Moreover, the suppression member 83 may be curved. Note that in the case where the suppression member 83 is curved, preferably the curve fits the shape of the tank 38 when the tank 38 expands.

In the above embodiment, a configuration may be adopted in which the tank 38 does not have the opening portion 61 to which the liquid introduction part 47 and the liquid supply part 48 are connected, and the liquid introduction part 47 and the liquid supply part 48 are connected separately to the body portion 63. That is, for example, a tank having an outer shape such as like the bottom portions 63 of two tanks 38 being joined to each other may be formed by blow molding, with the liquid introduction part 47 being connected to one opening portion and the liquid supply part 48 being connected to the other opening portion.

In the above embodiment, the introduction port 56 and the supply port 59 may open in any direction. For example, the supply needle 19 and the connection needle 28 may be movably provided, and the supply needle 19 and the connection needle 28 may be respectively inserted into the introduction port 56 and the supply port 59 of the liquid container 16 that is mounted in the mount part 17. Moreover, the introduction port 56 and the supply port 59 may open in different directions. For example, a configuration may be adopted in which one of the introduction port 56 and the supply port 59 opens forward in the mounting direction X, and the other opens backward in the mounting direction X.

In the above embodiment, the liquid introduction part 47 and the liquid supply part 48 may be provided such that the first central axis A1 passing through the center of the introduction port 56 and the second central axis A2 passing through the center of the supply port 59 intersect each other. That is, the liquid introduction part 47 and the liquid supply part 48 may be provided such that at least one of the first central axis A1 and the second central axis A2 extends in a direction intersecting the mounting direction when the liquid container 16 is mounted to the printing apparatus 11.

In the above embodiment, the liquid container 16 may be fixed with respect to the printing apparatus 11. That is, the liquid container 16 may be mounted to the printing apparatus 11 in an unremovable manner.

In the above embodiment, a configuration may be adopted in which the stirring member 68 is not provided. Moreover, the shape of the stirring member 68 is not limited to a sphere and may be an arbitrary shape such as a column, a polyhedron or the like. Furthermore, the number of the stirring members 68 can also be changed arbitrarily.

In the above embodiment, the tube 69 does not need to have the coil 70 wound thereon. For example, a linear hard member instead of the coil 70 may be attached to the tube 69. Furthermore, a hard pipe that does not have flexibility may be used instead of the tube 69. Moreover, a configuration may be adopted in which the tube 69 is not provided.

In the above embodiment, a configuration may be adopted in which the cover 49 is not provided on the liquid container 16.

In the above embodiment, a configuration may be adopted in which the suppression member 83 does not have the rear plate part 92. That is, for example, the bottom portion 63*a* of the tank 38 is thicker than the trunk body portion 63*b* and is not easily deformed, and thus expansion on the bottom portion 63*a* side is suppressed due to the rigidity of the tank 38 itself.

In the above embodiment, the opening 61 and the bottom portion 63*a* of the tank 38 do not need to face each other.

In the above embodiment, the bottom portion 63*a* may have the same flexibility as that of the trunk body portion 63*b*. That is, for example, deformation of the bottom portion 63*a* that expands in the same manner as the trunk body portion 63*b* may be suppressed by the suppression member 83.

In the above embodiment, the upper plate part and the lower plate part 88 do not need to have the openings 87*a* and 88*a* formed therein. Moreover, flexible portions that have flexibility and deform in the case where the flexible portions come into contact with the tank 38 may be provided instead of the openings 87*a* and 88*a*. Furthermore, considering deformation in the case where this tank 38 collapses as liquid stored in the tank 38 is reduced, the upper plate part 87 and the lower plate part 88 may be arranged to be separated from the tank 38. Moreover, a configuration may be adopted in which at least one of the upper plate part 87 and the lower plate part 88 is not provided.

In the above embodiment, the liquid inflow path and the liquid outflow path 72 may be formed at positions different from that of the lid part 64.

In the above embodiment, the end of the liquid inflow path 71 and the end of the liquid outflow path 72 may be positioned at positions separated from the lid part 64 by the same distance, without the tube 69 being provided. Moreover, the end of the liquid inflow path 71 may be at a position closer to the lid part 64 than the end of the liquid outflow path 72. That is, a configuration may be adopted in which the tube 69 is connected to the liquid outflow path 72 instead of the liquid inflow path 71, and liquid can be introduced from deep inside the tank 38. Moreover, the tubes 69 may be connected to both the liquid inflow path 71 and the liquid outflow path 72. Note that the shape of the tube 69 is not limited to a straight linear shape and may be a curved shape, and the length of the tube 69 can also be changed arbitrarily.

In the above embodiment, the first opening 78 of the first cap member 74 and the second opening 79 of the second cap member 75 do not need to be formed. For example, a flange may be formed on the first cap member 74 and the second cap member 75, and the first cap member 74 and the second cap member 75 may be fastened by a fastening member that sandwiches these flanges. Moreover, the first cap member 74 and the second cap member 75 may be fastened without using the fastening member. For example, the first cap member 74 and the second cap member 75 may be screwed to each other. Moreover, the first cap member 74 and the second cap member 75 may have an engaging portion and an engagement portion formed thereon and be engaged with each other.

In the above embodiment, the lid part 64 may have the first cap member 74 and the second cap member 75 formed integrally.

In the above embodiment, the lid part 64 may be configured such that a cap member having the first protrusion portion 76 formed thereon is mounted to the cylindrical wall portion 62 first, and subsequently a cap member having the second protrusion portion 77 formed thereon is mounted to the cylindrical wall portion 62. For example, a configuration may be adopted in which a columnar first cap member having the first protrusion portion 76 formed thereon is pushed into the sealing member 65, and furthermore a bottomed cylindrical second cap member having the second protrusion portion 77 formed thereon is mounted to the cylindrical wall portion 62 so as to press down the first cap member.

In the above embodiment, the first protrusion portion 76 does not need to be formed to have a cross section of a tapered shape. That is, the diameter of the first protrusion portion 76 may be constant from the opening portion 61 side to the body portion 63 side.

In the above embodiment, the method of molding the tank 38 is not limited to blow molding (hollow molding) in which molding is performed by blowing air into a material having a pipe shape or a substantially test tube-like shape, and the tank 38 may be molded by another method. For example, the tank 38 may be molded by inflation molding in which molding is performed by blowing air into a material extruded out of an extruder while the material is soft. Moreover, the tank 38 may be molded by transfer molding (press-in molding) or injection molding in which the material is pushed into a mold while pressure is applied. Furthermore, the tank 38 may be molded by compression molding in which molding is performed by applying pressure to a material that has been put in a mold. Moreover, the tank 38 may be molded by vacuum molding in which a material is pressed against a mold by suctioning air between the heated material and the mold, or by pressure molding in which the pressure between a material and a mold is reduced and compression air is simultaneously injected on the material side. The tank 38 may also be molded by pouring a molten material into a mold.

The liquid can be arbitrarily selected as long as the liquid can be printed onto the medium P by adhering to this medium P. Note that it is sufficient that the liquid is a substance in a liquid phase, and the liquid includes a fluid body such as a liquid body having high or low viscosity, sol, gel water, another inorganic solvent, an organic solvent, a solution, liquid resin, or liquid metal (metal melt). Not only a liquid as one state of a substance, but also particles of a functional material composed of a solid substance such as a pigment or metal particles that are dissolved, dispersed or mixed in a solvent or the like are included. A typical example of the liquid is ink. Ink includes typical water-based ink and oil-based ink, and various types of liquid compositions such as gel ink and hot melt ink.

The medium P may be paper, a resin film, a resin sheet, a paper resin composite film (resin-impregnated paper, resin coated paper or the like), metal foil, a metal plate, a metal film, a resin metal composite film (lamination film), a fabric, a nonwoven fabric, a ceramic sheet, a disk or the like.

The printing apparatus 11 is an apparatus that prints images such as text, pictures, or photos by causing a liquid to adhere to a medium, and may be a serial printer, a lateral type printer, a line printer, a page printer or the like. The printing apparatus 11 may also be an offset printing apparatus, a textile printing apparatus or the like. Moreover, it is sufficient that the printing apparatus at least has a printing function of performing printing on a medium, and the printing apparatus may be multifunctional printer that has other functions in addition to the printing function. Furthermore, the printing apparatus may be an apparatus that performs printing on not only a two-dimensional medium but also a medium having a three-dimensional curved surface.

The entire disclosure of Japanese Patent Application No. 2015-020965, filed Feb. 5, 2015 is expressly incorporated by reference herein.

What is claimed is:

1. A liquid container mountable to a printing apparatus that performs printing by discharging a liquid and capable of storing a liquid supplied in a pressurized state, the liquid container comprising:

a housing;

a liquid introduction part formed in a first end of the housing through which the liquid is introduced;

a flexible tank provided in the housing and configured to store the liquid introduced from the liquid introduction part, the flexible tank configured to expand when the liquid is introduced into the flexible tank and configured to collapse when the liquid is removed from the flexible tank; and a liquid supply part formed in an opposing second end of the housing that supplies the liquid in the tank to the printing apparatus, wherein the tank is molded; and wherein the liquid container is removable from the printing apparatus.

2. The liquid container according to claim 1, wherein the tank is molded by blow molding.

3. The liquid container according to claim 1, wherein the liquid introduction part and the liquid supply part are formed such that a first central axis passing through a center of an introduction port that opens outward in the liquid introduction part is substantially parallel with a second central axis passing through a center of a supply port that opens outward in the liquid supply part, and the liquid introduction part and the liquid supply part extend in a mounting direction when the liquid container is mounted to the printing apparatus.

4. The liquid container according to claim 1, wherein the introduction port that opens outward in the liquid introduction part and the supply port that opens outward in the liquid supply part open forward in the mounting direction in which the liquid container is mounted to the printing apparatus.

5. The liquid container according to claim 1, wherein the tank is formed by integrally molding an opening portion to which the liquid introduction part and the liquid supply part are connected and a body portion.

6. A liquid container mountable to a printing apparatus that performs printing by discharging a liquid and capable of storing a liquid supplied in a pressurized state, the liquid container comprising:

a housing;

a liquid introduction part formed in a first end of the housing through which the liquid is introduced;

a flexible tank provided in the housing and configured to store the liquid introduced from the liquid introduction part, the flexible tank configured to expand when the liquid is introduced into the flexible tank and configured to collapse when the liquid is removed from the flexible tank; and a liquid supply part formed in an opposing second end of the housing that supplies the liquid in the tank to the printing apparatus, wherein the tank is molded the housing includes a first storage portion that is configured to be positioned outside of the printing apparatus, and a second storage portion that is configured to be positioned inside of the printing apparatus, and a first insertion hole is formed on a first front surface of the first storage portion, and a second insertion hole is formed on a second front surface of the second storage portion.

7. The liquid container according to claim 6, wherein the first insertion hole and the second insertion hole open forward in a mounting direction of the liquid container to the printing apparatus.

8. The liquid container according to claim 7, wherein a connection needle and a supply needle provided in the printing apparatus are configured to be individually inserted into the first insertion hole and the second insertion hole, respectively.

9. The liquid container according to claim 6, wherein a connection needle and a supply needle provided in the printing apparatus are configured to be individually inserted into the first insertion hole and the second insertion hole, respectively.

* * * * *